US006152725A

United States Patent [19]

Lee

[11] Patent Number: 6,152,725

[45] Date of Patent: Nov. 28, 2000

[54] TURBO JET LIGHTER

[75] Inventor: Byung Kug Lee, Seoul, Rep. of Korea

[73] Assignee: WIN Corporation LTD, Rep. of Korea

[21] Appl. No.: 09/396,125

[22] Filed: Sep. 14, 1999

[51] Int. Cl.[7] ..... F23Q 2/16; F23Q 2/34

[52] U.S. Cl. ..... 431/266; 431/344; 431/354; 431/285

[58] Field of Search ..... 431/278, 285, 431/266, 354, 265, 283, 264, 344

[56] References Cited

U.S. PATENT DOCUMENTS

| | | | |
|---|---|---|---|
| 1,928,428 | 9/1933 | Irwin | 431/284 |
| 4,505,666 | 3/1985 | Martin et al. | 431/285 |
| 5,423,483 | 6/1995 | Schwade | 239/11 |
| 5,711,662 | 1/1998 | Ishiguro | 431/344 |

FOREIGN PATENT DOCUMENTS

| | | | |
|---|---|---|---|
| 2615597 | 11/1988 | Japan | 431/126 |
| 11-6620 | 1/1999 | Japan | 431/280 |
| WO 81/00751 | 3/1981 | WIPO | 431/263 |

*Primary Examiner*—Carl D. Price
*Attorney, Agent, or Firm*—Pendorf & Cutliff

[57] ABSTRACT

Provided with a nozzle insulator including,: an insulator body formed from an insulator material; a nozzle guider provided in the insulator body; a through hole formed in the wall of the insulator body; and multiple nozzles of a flame generator to provide power of high-temperature flames.

5 Claims, 3 Drawing Sheets

TURBO JET LIGHTER

BACKGROUND OF THE INVENTION

1. Field of the Invention

The present invention relates to a nozzle insulator and, more particularly, to a nozzle insulator associated with a turbo jet lighter to provide multiple nozzles and hence high power of hot flames.

2. Discussion of Related Art

A related art torch type turbo jet lighter typically includes one nozzle, or one turbo nozzle plus one normal flame. But, this lighter is disadvantageous in that the flame has such a low temperature as not to be used for a torch for working on precious metals.

Also, the upper part of the related art lighter is associated with a gas exhaust pipe combined with the tip of a nozzle. Such a lighter is provided in some cases with a torch usable for working on precious metals but hardly can be used to work on precious metals except gold because the temperature of the flame is too low.

SUMMARY OF THE INVENTION

It is therefore an object of the present invention to provide a nozzle insulator associated with a torch type turbo jet lighter or a torch designed to provide multiple nozzles and thereby generate powerful hot flames.

To achieve the first object of the present invention, there is provided a nozzle insulator including a nozzle guider provided with a plurality of round holes for insulating a plurality of turbo nozzles.

Specifically, the present invention provides a nozzle insulator including: an insulator body formed from an insulator material; a nozzle guider provided in the insulator body; a through hole formed in the wall of the insulator body; and multiple nozzles of a flame generator to provide power of high-temperature flames.

In accordance with an embodiment of the present invention, the insulator body has a rectangular form and the nozzle guider includes a double nozzle guider having two round holes.

In accordance with another embodiment of the present invention, the insulator body has the form of a triangular prism and the nozzle guider includes a triple nozzle guider having three round holes.

Therefore the present invention includes two or more separate nozzles associated with each other to provide multiple turbo jet flames that are succeedingly burnt from the separate nozzles.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

DETAILED DESCRIPTION OF PREFERRED EMBODIMENT

Hereinafter, the present invention will be described in detail with reference to the accompanying drawings.

Figure 1:
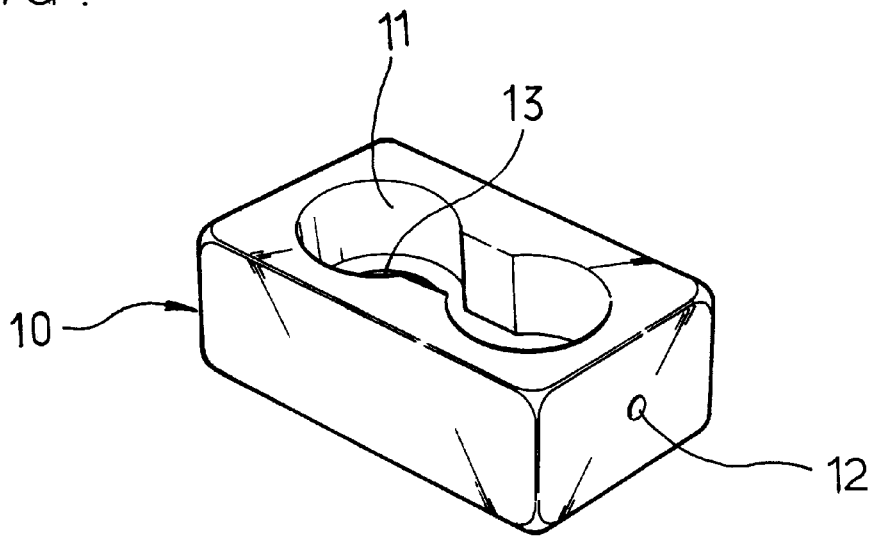
FIG. 1 is a perspective view of an embodiment of the present invention nozzle insulator.

FIG. 1 is a perspective view of an embodiment of the present invention nozzle insulator, in which the nozzle insulator includes an insulator body 10 formed from an insulator material such as insulating ceramic, a nozzle guider 11 formed in the insulator body 10, and a through hole 12 provided in the wall of the insulator body 10.

In the embodiment of FIG. 1, the nozzle guider 11 formed in the insulator body 10 of the nozzle insulator includes a double nozzle guider 11 that is associated with two nozzles of a turbo jet lighter or a torch. The insulator body 10 has a rectangular form and the double nozzle guider 11 has two round holes 13 piercing through to the insulator body 10.

Figure 2:
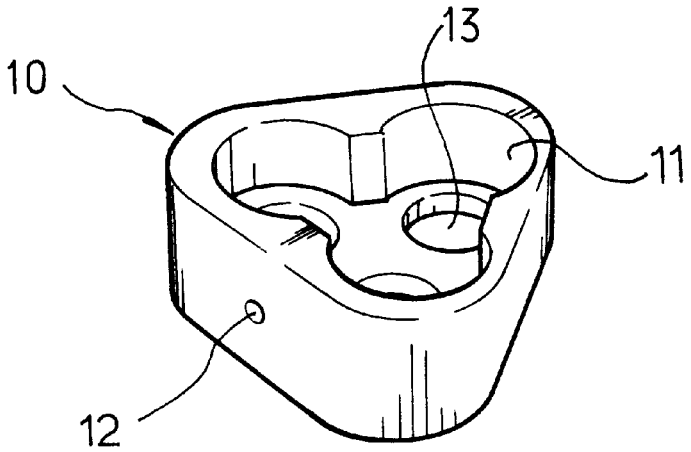
FIG. 2 is a perspective view of another embodiment of the present invention nozzle insulator.

FIG. 2 is a perspective view of another embodiment of the present invention nozzle insulator, in which the nozzle insulator includes an insulator body 10 and a triple nozzle guider 11 associated with three nozzles. The insulator body 10 has the form of a triangular prism and the triple nozzle guider 11 has three round holes piercing through to the insulator body 10.

Figure 3:
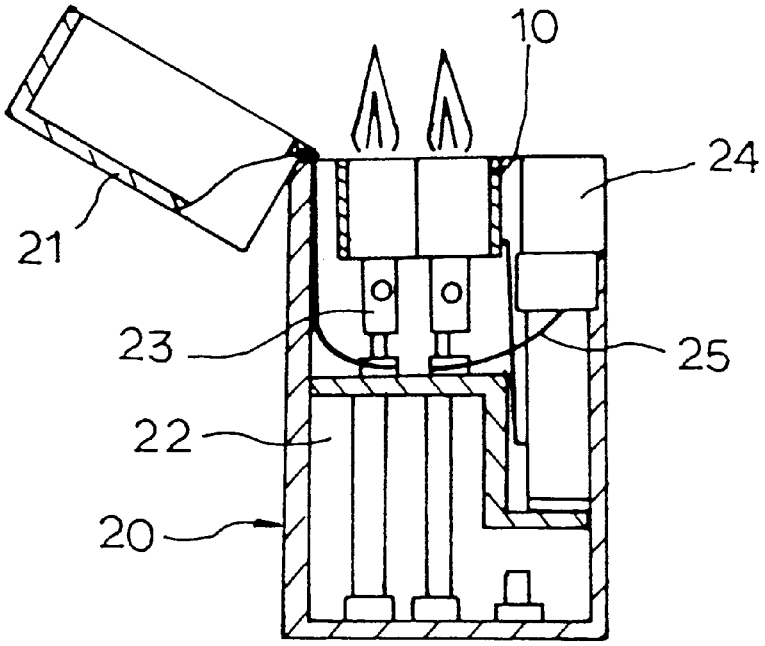
FIG. 3 is a vertical cross-sectional view of a lighter associated with a double-hole type nozzle insulator.
Figure 4:
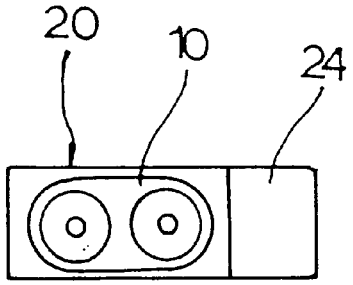
FIG. 4 is a plan view of the lighter shown in FIG. 3.
Figure 5:
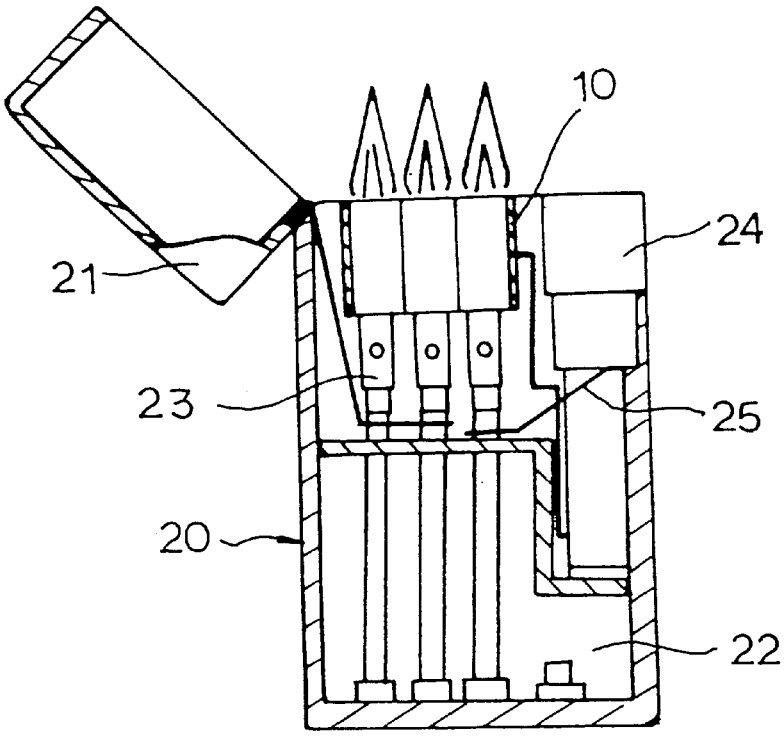
FIG. 5 is a vertical cross-sectional view of a lighter associated with a triple-hole type nozzle insulator.

FIG. 3 is a vertical cross-sectional view of a lighter associated with a double-hole type nozzle insulator and FIG. 4 is a plan view of the lighter. FIG. 5 is a vertical cross-sectional view of a lighter associated with a triple-hole type nozzle insulator and FIG. 6 is a plan view of the lighter.

As illustrated, a cover 21 is hinged to a case 20 and a gas tank 22 is associated with the interior part of the case 20. The upper interior part of the case 20 is associated with two turbo nozzles 23 for forming jet flames, and the one interior side of the case 20 is associated with an ignitor 24 and an ignitor lead 25 that extends to a discharging side of the turbo nozzles 23.

In this portable turbo jet lighter, the present invention nozzle insulator in use is fixed to the upper part of the case 20 and associated with the turbo nozzles 23.

Figure 6:
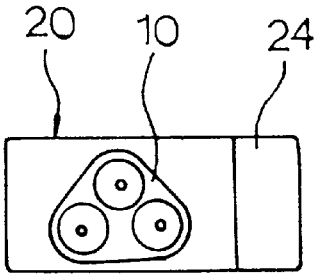
FIG. 6 is a plan view of the lighter shown in FIG. 5.

The turbo jet lighter shown in FIGS. 3 and 4 includes the same structure as that shown in FIGS. 5 and 6 with an exception that the former is associated with a nozzle insulator having the double nozzle guider 11 and the latter is associated with a nozzle insulator having the triple nozzle guider 11.

The turbo jet lighter implemented with the present invention can catch turbo jet flames succeedingly through the separate nozzles. That is, one ignitor is sufficient to turn the turbo jet lighter on since the flames arranged at appropriate intervals are succeedingly burnt.

Thus, the present invention turbo jet lighter can provide powerful hot flames through multiple turbo nozzles 23.

Although the present invention is applied to the torch type turbo jet lighter in the above description, it can also be used for industrial torches for working on precious metals and other products so long as they generate flames from nozzles.

As described above, the present invention provides multiple nozzles in a flame generator such as a turbo lighter or a torch to maintain the power of high-temperature flames and thereby enhance the products' quality, performance and competitiveness.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A turbo jet lighter comprising;

a case having an upper end and a lower end, a fuel reservoir associated with the interior part of the case, a hollow nozzle insulator in the upper interior part of the case, the nozzle insulator defining a sidewall and comprising;

an insulator body formed from an insulator material;

multiple nozzle guide holes provided in an inlet wall of the insulator body;

at least one through hole formed in the sidewall of the insulator body; and multiple turbo jet nozzles each arranged in one of said nozzle guide holes and forming a flame generator, said turbo jet nozzles arranged to be supplied with fuel from said fuel reservoir, and a manually operated ignition mechanism for igniting the fuel at the flame generator to provide power of high-temperature flames.

2. The turbo jet lighter as claimed in claim 1, wherein the insulator body has a rectangular form and the nozzle guider holes include two round holes.

3. The turbo jet lighter as claimed in claim 1, wherein the insulator body has the form of a triangular prism and the nozzle guider holes include three round holes.

4. A turbo jet lighter as in claim 1, further including a cover hinged to said case at said upper end.

5. A turbo jet lighter as in claim 1, wherein said turbo jet nozzles include a cylindrical body within which fuel and air are mixed prior to ignition.

* * * * *